United States Patent [19]

Russo et al.

[11] 4,401,036

[45] Aug. 30, 1983

[54] OVERBED TABLE

[75] Inventors: Joseph Russo; Richard Sonder, both of New York, N.Y.; Robert E. Miller, Charlotte; Mark E. Cauthen, Pineville, both of N.C.

[73] Assignee: Simmons Universal Corporation, New York, N.Y.

[21] Appl. No.: 230,994

[22] Filed: Feb. 3, 1981

[51] Int. Cl.[3] ..... A47B 9/00

[52] U.S. Cl. ..... 108/146; 108/50; 108/106; 108/144; 108/150

[58] Field of Search ..... 108/146, 150, 136, 174, 108/106, 144, 50; 248/447; 312/225, 226

[56] References Cited

U.S. PATENT DOCUMENTS

| | | | |
|---|---|---|---|
| 1,232,757 | 7/1917 | Berkey | 108/137 X |
| 1,394,526 | 10/1921 | Amsden | 108/141 X |
| 1,653,657 | 12/1927 | Pretsch | 108/141 |
| 1,897,884 | 2/1933 | Biery | 108/141 X |
| 2,449,492 | 9/1948 | Long | 248/447 X |
| 2,566,830 | 9/1951 | Goldsmith | 312/226 X |
| 2,733,110 | 1/1956 | Berner et al. | 108/50 X |
| 2,795,473 | 6/1957 | Smith | 312/226 X |
| 3,194,187 | 7/1965 | Linder et al. | 108/146 |
| 3,207,099 | 9/1965 | Black et al. | 108/141 |
| 3,314,384 | 4/1967 | Mann et al. | 108/146 |
| 3,393,649 | 7/1968 | Miotke | 108/141 X |
| 3,435,783 | 4/1969 | Kollenborn | 108/141 X |
| 3,444,830 | 5/1969 | Doetsch | 108/136 |
| 3,910,659 | 10/1975 | Peterson | 312/226 |

*Primary Examiner*—James T. McCall

[57] ABSTRACT

A table is provided for use in association with a bed including a base member, a tubular support column and a table top. The support column includes an upper tubular portion telescopically mounted over a lower tubular portion; a locking spring mechanism for maintaining upward tension against the upper portion; release means for overcoming the spring mechanism to permit lowering of the upper portion; and means to permit the table top to horizontally pivot a pre-determined amount relative to the support column and be locked in a fixed position. The table top is mounted to the support column, in cantilever fashion, and includes a mirror recessed in the table top.

4 Claims, 13 Drawing Figures

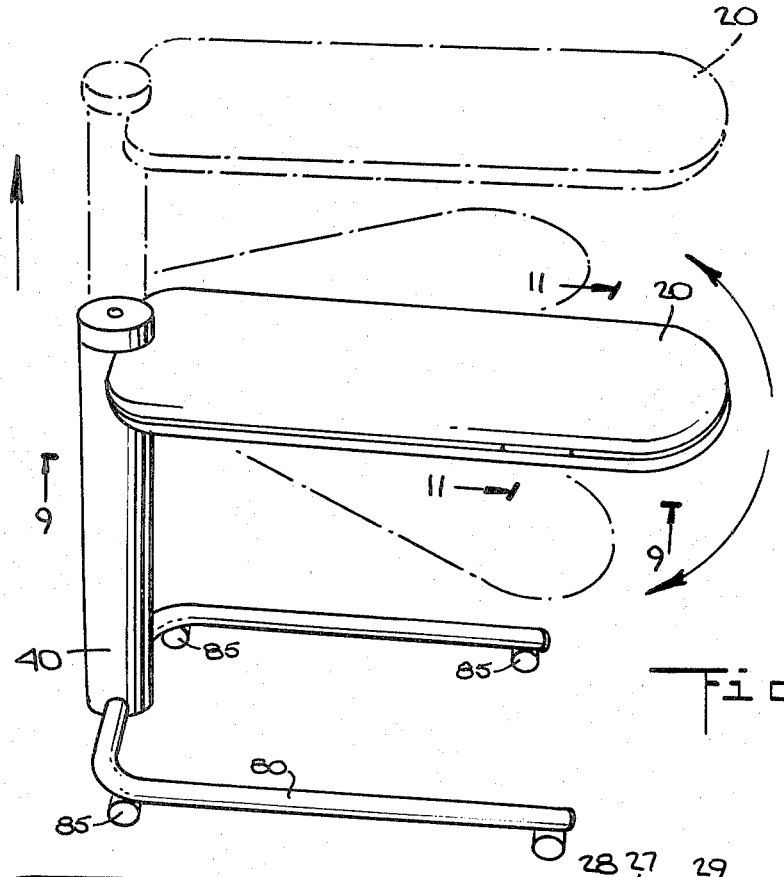
Fig. 4.
Fig. 9.
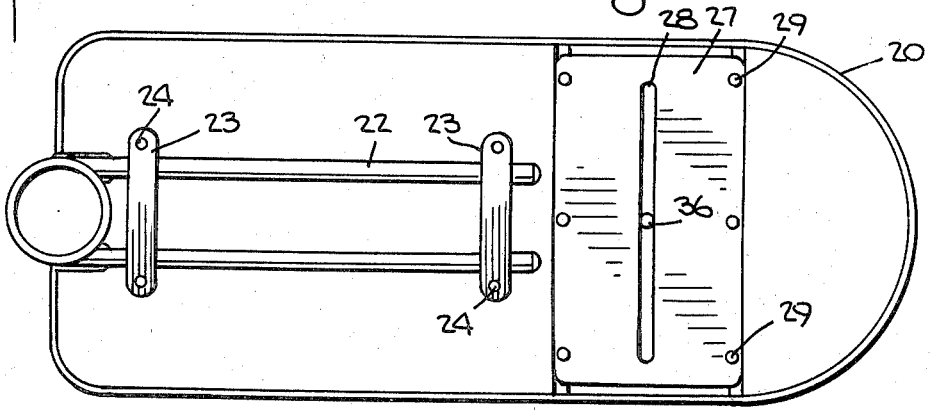
Fig. 10.
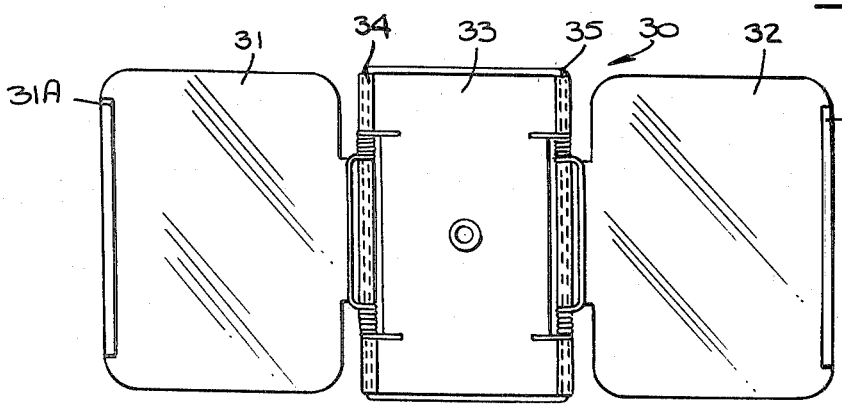

20
27
28
31
31A
32
32A
33
34
35
36

OVERBED TABLE

BACKGROUND OF THE INVENTION

The present invention relates generally to an overbed table and, more particularly, to an overbed table of the free rise type including a base, a support column and a table for use in a patient care facility which employs a spring mechanism for raising the table top. The overbed table of the present invention further includes at the top of the support column, a top mounted release mechanism for overcoming the spring force to permit lowering of the table; cantilever means for affixing the table top to the support column, thus eliminating the need for a mounting bracket positioned under the table top; means to permit the table top to horizontally pivot relative to the support column and a mirror recessed within the table top for use by patients.

Most commercially available overbed tables fall into two categories: hand crank and free rise models. The hand crank models, as exemplified by U.S. Pat. No. Des. 169,460, which issued to L. Smith on Apr. 28, 1953 and U.S. Pat. No. 3,393,649, which issued to N. Miotke on July 23, 1963, employ a gear drive powered by a manual hand crank for raising and lowering the table top. The free rise models, as exemplified by U.S. Pat. Nos. 3,314,384, which issued to S. N. Mann et al. on Apr. 18, 1967; 3,380,405, which issued to C. J. Barecki et al. on Apr. 30, 1968; and 3,999,492, which issued to H. Emrick on Dec. 28, 1976, employ a constant force spring mounted within the column to maintain a constant, upward force against the table top. In this manner, the spring mechanism assists upward adjustment of the table top with a locking mechanism typically being provided to lock the table top at a particular height. Release means are further provided to override the affect of the spring and permit downward adjustment of the table top.

Heretofore, most free rise overbed tables have employed mechanical tension springs for effecting this upward force as well as release means which typically take the form of a lever located under the table top. This combination of the lever and mounting bracket, both of which were located below the table top, oftentimes prevented the hospital patient, particularly the seriously ill patient, from adjusting the height of the table top without seeking assistance from a nurse or orderly. Moreover, due to the bracket under the table top which would contact the arms of the chair, conventional overbed tables could not be used in conjunction with arm chairs as the top could not be lowered sufficiently to permit use by a patient.

Furthermore, due to the particular construction of these earlier free rise tables, none offered a table top which was capable of being pivoted relative to the support column. The ability of the table top of the present invention to pivot relative to the support column permits a patient to clear away the table by merely swinging away the top rather than rolling away the entire table. This is of particular importance with the seriously ill patient who may lack the strength to physically push away the entire table. It further permits use in situations where overbed tables heretofore could not be used.

Against the foregoing background, it is a primary object of the present invention to provide a free rise overbed table which utilizes a spring mechanism to counter-balance the weight of the table top.

It is another object of the present invention to provide an overbed table including a table top which is pivotably mounted relative to the column, using an internal cantilever to permit horizontal movement of the table top.

It is yet another object of the present invention to provide an overbed table in which a retractable mirror is provided within the table top for use by the patient.

SUMMARY OF THE INVENTION

To the accomplishments of the foregoing objects and advantages, the present invention briefly comprises an overbed table for use in association with a bed including a base member, a tubular support column and a table top. The support column comprises an upper tubular portion telescopically mounted over a lower tubular portion and includes a locking spring mechanism for maintaining upward tension against the upper portion to which the table top is attached; release means for overcoming the spring mechanism to permit lowering of the table top; and means to permit the table top to pivot a pre-determined amount about the lower portion and yet be locked in a fixed position. The table top is cantilever mounted to the upper portion and includes a mirror recessed in the table top.

BRIEF DESCRIPTION OF THE DRAWINGS

The foregoing and still other objects and advantages of the present invention will be made apparent from the following detailed explanation of the preferred embodiments of the invention in connection with the accompanying drawings, wherein:

FIG. 4 is a perspective view of the overbed table of the present invention illustrating the various positions which the table may assume;

FIG. 9 is a view taken along line 9—9 of FIG. 4;

FIG. 10 is a top view illustrating the mirror assembly of the present invention;

DESCRIPTION OF THE PREFERRED EMBODIMENTS

Figure 1:
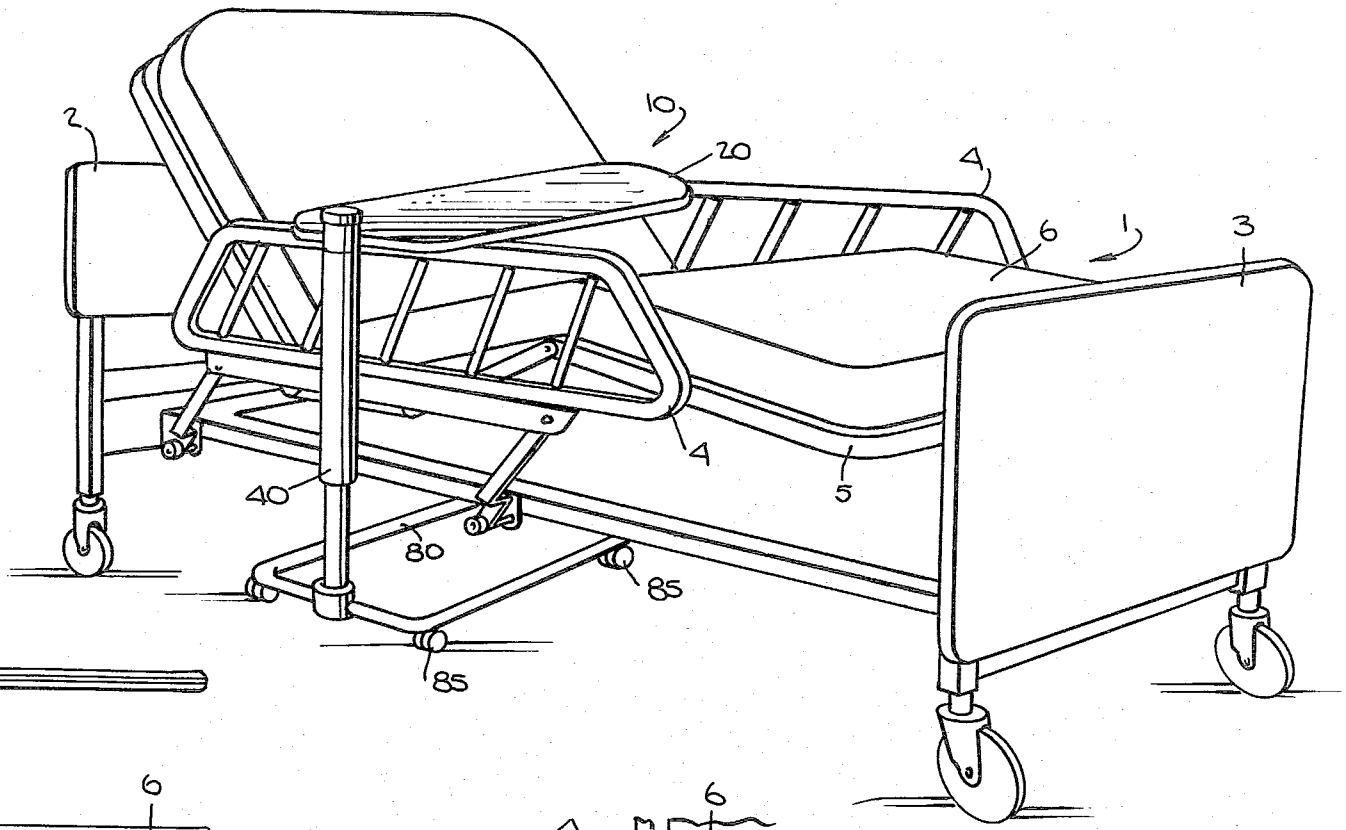
FIG. 1 is a perspective view illustrating the overbed table of the present invention in combination with a conventional hospital bed.

Referring now to the drawings and, in particular to FIG. 1 thereof, there is shown the overbed table of the present invention, referred to generally by reference numeral 10, as it is typically positioned relative to a conventional hospital bed 1 of the type having head and foot boards 2 and 3, respectively; a pair of opposed side rails 4; and an adjustable bed pan 5 for supporting a mattress 6.

Figure 2:
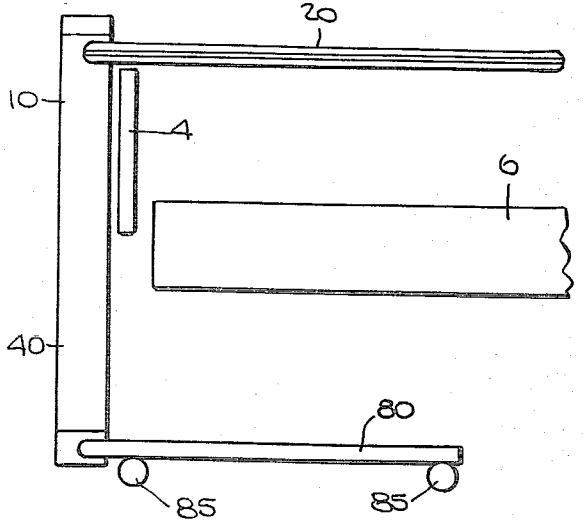
FIG. 2 is a front view of the table and bed combination of FIG. 1.
Figure 3:
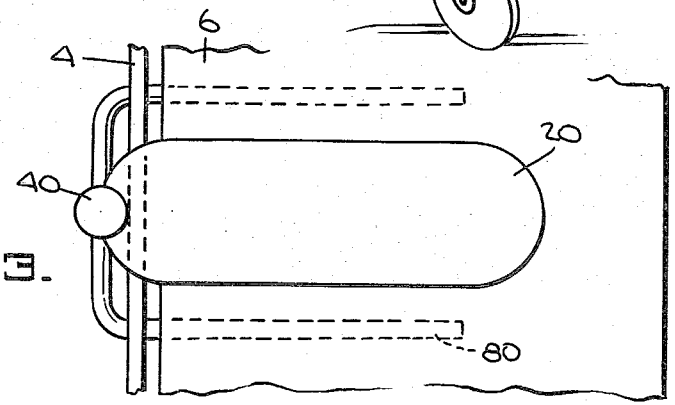
FIG. 3 is a top view thereof.

The overbed table 10 includes a table top 20 pivotably mounted on a support column 40 secured to a generally C or U-shaped base member 80. As shown in FIGS. 1–3, the table 10 may be positioned immediately adjacent to a hospital bed 1 with the base member 80 sliding under the bed and with the table top 20 extending over one of the side rails 4 to permit use by a patient. FIGS. 1–3 illustrate a typical placement of the overbed table 10 relative to hospital bed 1.

The construction of the support column 40 and table top 20 are shown in greater detail in FIGS. 5–8. FIG. 4 demonstrates the ability of the table top 20 to horizontally pivot relative to the support column 40, and FIGS. 8–13 illustrate the placement of a concealed and retractable mirror assembly 30 within table top 20.

Figure 8:
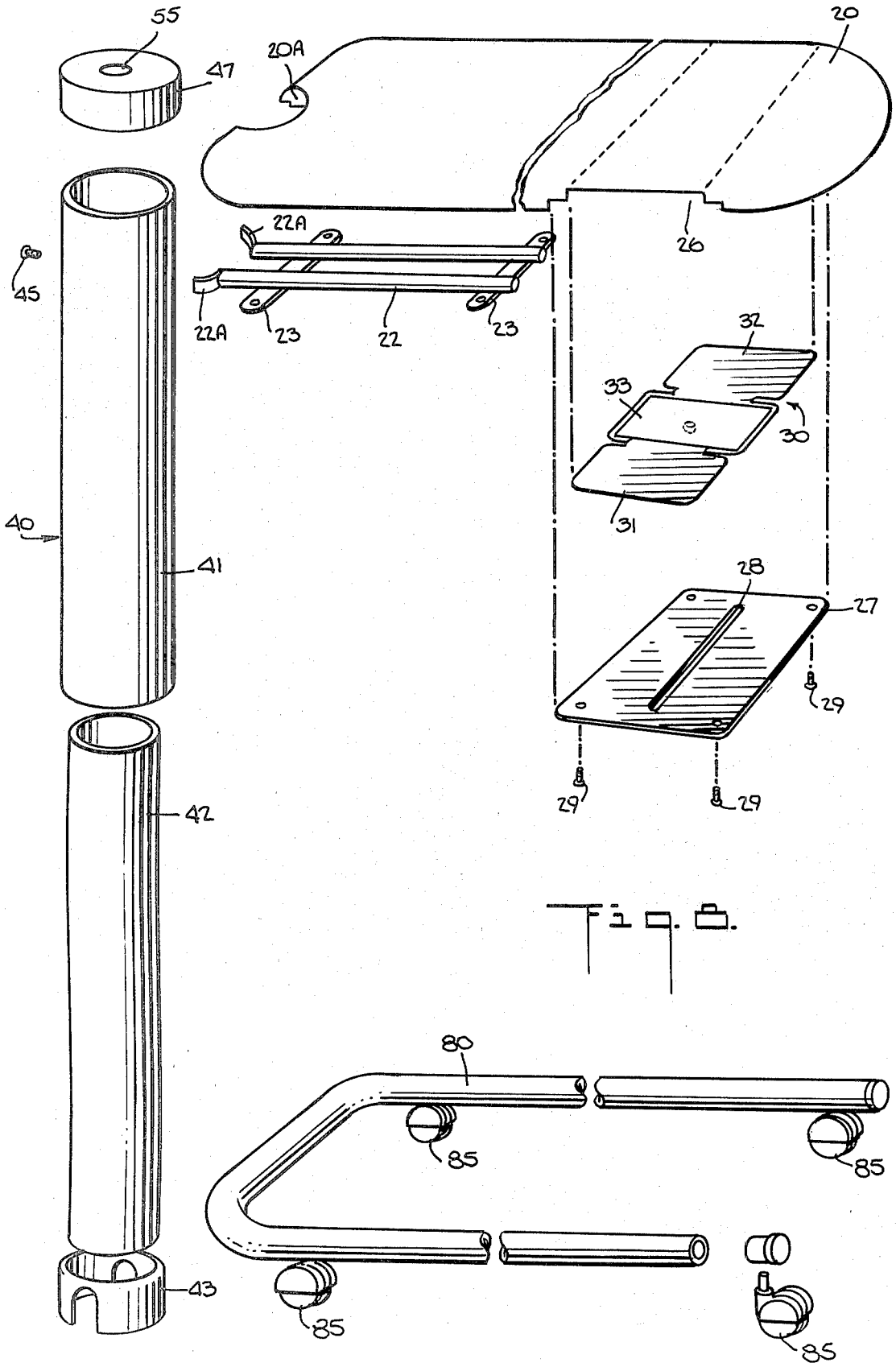
FIG. 8 is a breakaway view of the overbed table illustrating the interaction of its various elements.

As best illustrated in FIG. 8, table top 20, which may be fabricated from virtually any material including, for example, thermoplastics, natural wood and/or wood laminates or any combination thereof, is secured to support column 40 by cantilever arm 22 which, as shown in FIGS. 5–8, is adapted to be received in generally U-shaped grooves on the lower surface of table top 20. Cantilever arm 22 is secured to the underside of table top 20 by at least two mounting brackets 23 which are affixed to the underside of table top 20 by a plurality of screws 24. In this manner, while table top 20 is mounted in a cantilever fashion to support column 40, cantilever arm 22 is virtually hidden from view as it is received in the grooves on the underside of the table top 20. This eliminates the need for bulky brackets which heretofore had extended down underneath typical overbed table tops which, when combined with conventional release mechanisms, oftentimes restricted the use of the table, as they prevented the table from being used in conjunction with an arm chair.

While one end of cantilever arm 22 is captured within grooves on the underside of the table top 20, the opposite end of cantilever arm 22 terminates at flared ends 22A which generally conform to a curved, indentation 20A on the table top 20 where the table top 20 is adapted to mate with support column 40 in a manner which will be described in greater detail.

As shown in greater detail in FIGS. 8–13, a hinged, three-part mirror assembly 30 is provided for retention within a channel 26 provided on the underside of table top 20 across its width. A retaining plate 27, which includes a center slide groove 28 extending lengthwise but terminating short of each end of retaining plate 27, is provided which, by plurality of retaining screws 29, is adapted to capture mirror assembly 30 between the retaining plate 27 and the underside of the table top 20 within channel 26.

Figures 11, 12, 13:
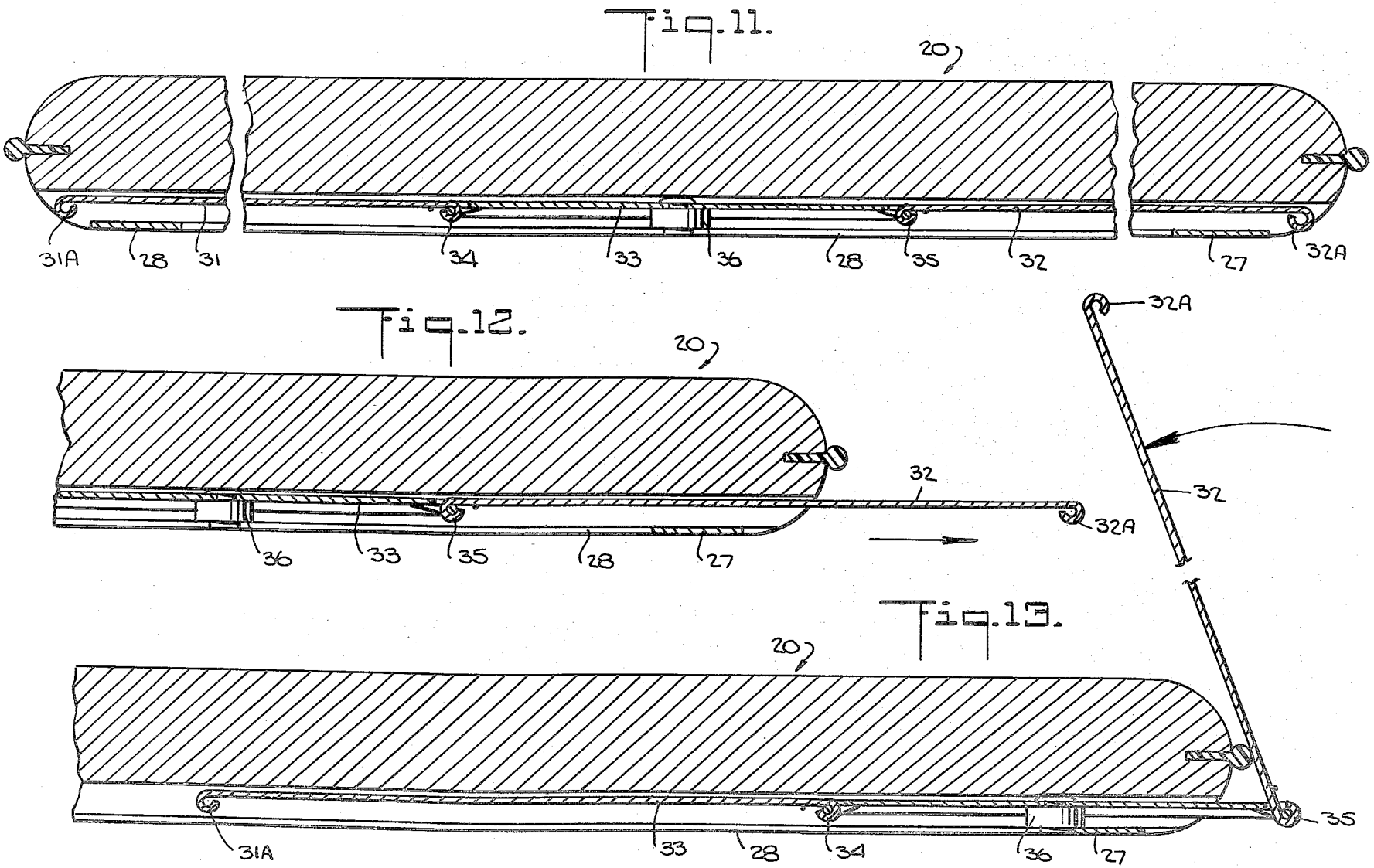
FIG. 11 is a sectional view taken along line 11—11 of FIG. 4.
FIGS. 12 and 13 are sectional views of the table top illustrating the manner in which the mirror may be removed and utilized.

Mirror assembly 30, as best shown in FIG. 10, includes two opposite mirror portions 31 and 32 pivotably secured to a center portion 33 by hinges 34 and 35. Mirror portions 31 and 32 each include curled outer edges 31A and 32A which permit a patient to grasp the mirror assembly 30 and withdraw it from the table top 20. Mirrors 31 and 32 may be fabricated from virtually any image reflecting material such as, for example, glass or plastic, highly polished sheets of stainless steel, etc. As shown in FIGS. 11–13, a slide block 36 is provided on the underside of center portion 33 and is captured between retaining plate 27 and table top 20. As shown in FIGS. 11–13, the mirror assembly 30 may be withdrawn from either edge of table top 20 by withdrawing the mirror portions 31 and 32 to a position where slide block 36 reaches the end of slide groove 28 and engages retaining plate 27. At that point, the hinges 34 or 35 are clear of the edge of table top 20 and the mirror portion 31 or 32 is then upwardly bent to accommodate a patients' use.

Figures 5, 6, 7:
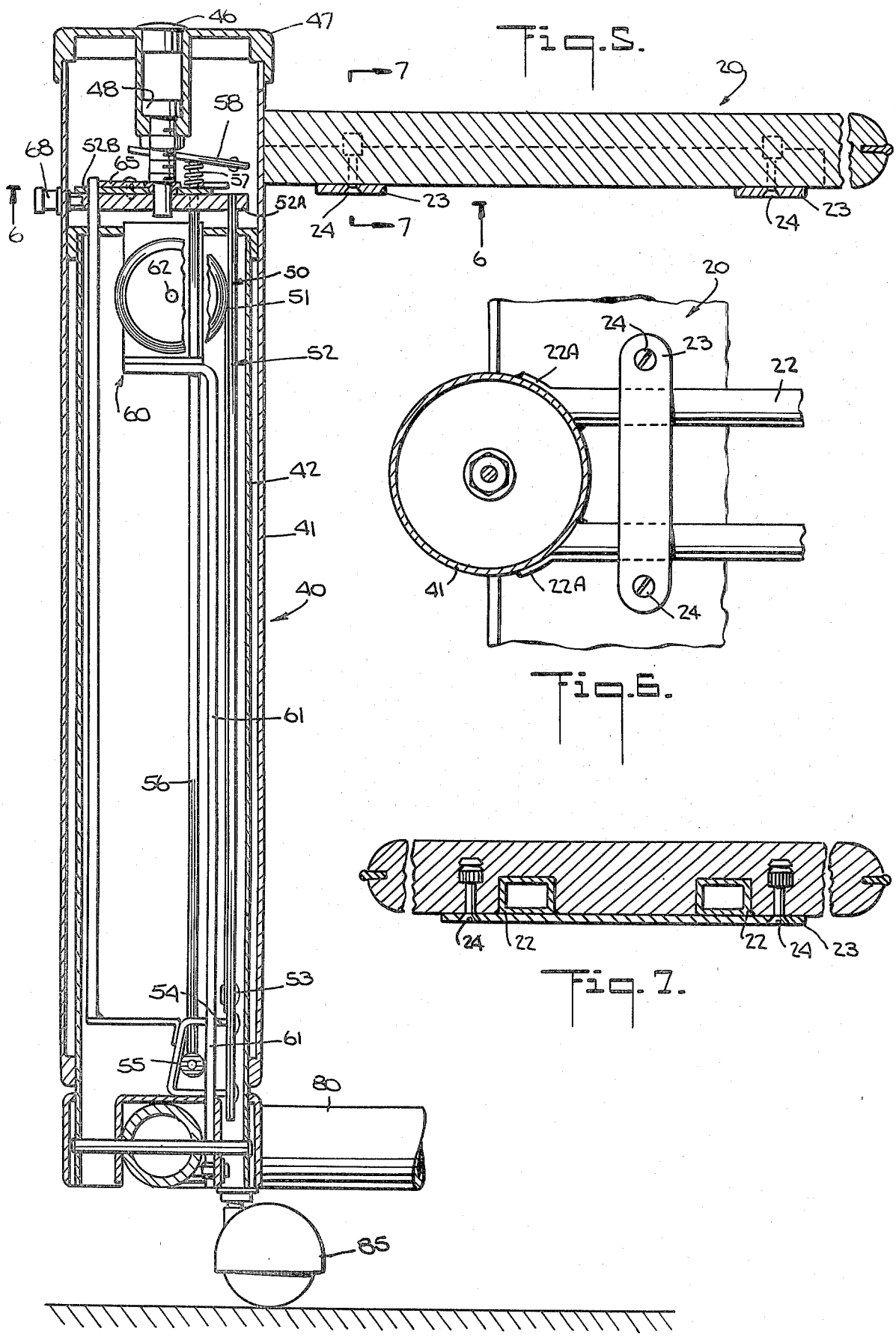
FIG. 5 is a cutaway view of the support column and table top of the overbed table.
FIG. 6 is a sectional view taken along line 6—6 of FIG. 5.
FIG. 7 is a sectional view taken along line 7—7 of FIG. 5.

Table top 20 is pivotably secured to support column 40 in a cantilever manner by cantilever arm 22. Support column 40, as shown in FIGS. 5 and 8, includes upper tubular portion 41 telescopically mounted over lower tubular portion 42 which is retained within base collar 43. As shown in FIG. 6, table top 20 is secured to upper tubular portion 41 with tubular portion 41 fitted within the curved indentation 20A of the table top 20 and with the flared ends 22A of cantilever arm 22 being affixed by conventional securing means, i.e., screws, etc. to the outer surface of the upper tubular portion 41. Due to the telescoping mounting of upper tubular portion 41 over lower tubular portion 42, and the general tubular configuration of the two portions, upper tubular portion 41 is capable of being able to rotate about lower tubular portion 42, thus permitting table top 20, which is attached to upper portion 41, to be pivoted relative to lower portion 42.

The free rise vertical movement of table top 20 is accomplished by a generally conventional locking spring mechanism designated generally by reference numeral 50 contained within support column 40 as shown, for example, in FIG. 5. Locking spring mechanism 50 exerts an upward force against table top 20 due to the action of leaf spring 51 which maintains actuator bracket assembly 52 in a constant raised position. Leaf spring 51 is secured to actuator bracket assembly 52 by rivet 53. Actuator bracket assembly 52 includes a cage section 54 through which passes a spacer glide 61 of a spring mounting bracket assembly 60 on which is mounted the leaf spring 51 at spring axle 62. Between one edge of cage section 54 and actuator bracket assembly 52 is contained actuator roller 55 which is connected to an actuating rod 56 spring loaded at spring 57 to pressure plate 58. The one edge of cage 54 is angularly related to spacer glide 61 so that upon depression of pressure plate 58, roller 55 is pushed downwardly and released, permitting downward movement of actuator bracket assembly 52 and upper tubular portion 41 of support column 40 to which it is attached.

Pressure plate 58 is actuated by support column cap 47. Depression of cap 47 depresses pressure plate 58, overcome its spring load, and unlock roller 55. In a normal, undepressed state, roller 55 is firmly wedged between the angularly related side of cage 54 and actuator bracket assembly 52 to lock the actuator bracket assembly 52 in a fixed position relative to mounting bracket assembly 60.

It is understood that in an alternative embodiment (not shown), locking spring mechanism may be replaced entirely with a gas spring mechanism attached to both the upper and lower tubular portions 41 and 42 in order to maintain constant upward pressure. Gas springs have been used for a number of years in other applications such as, for example, to secure auto luggage compartments and engine hoods, for height adjustment in chairs and on compartment doors for ships and barges. The advantage offered by the use of a gas spring in the instant application is that it would substantially reduce the number of mechanical parts required. The raising and lowering of table top 20 would be accomplished by the use of an externally mounted control means (not shown) to activate the gas spring in both directions.

In the embodiment of FIG. 5, horizontal pivoting of table top 20 is restricted by the action of mounting plate 65 mounted above the upper bracket 52A of actuator bracket assembly 52 and which receives the nub 52B of the assembly 52 through a slot contained on its face. The actuator bracket assembly is locked in place relative to upper tubular portion 41 by spring loaded restraining knob 68 which is adapted to be inserted in a groove contained on bracket 52A. By withdrawal of knob 68 and disengagement with the bracket 52A, upper tubular portion 41 and table top 20 attached thereto are capable of being rotated and pivoted about lower portion 42 in a horizontal plane. The engagement of nub 52B within a slot on mounting plate 65 limits the horizontal pivot of the upper tubular portion 41 and likewise the table top 20 to the extent of the length of the slot. In this manner, the horizontal pivot of the table top is limited and it is capable of being locked in a fixed position.

The lower tubular portion 42 is mounted on a generally U-shaped tubular base member 80 which includes casters 85 to permit the table 10 to roll about. Base member 80 is preferably aligned, as shown in FIG. 1, with support column 40 secured to the bottom portion of the letter "U" and with the table top 20 and base member 80 extending in the same directions.

Having thus described the invention with particular reference to the preferred forms thereof, it will be obvious that various changes and modifications may be made therein without departing from the spirit and scope of the invention as defined in the appended claims.

What is claimed is:

1. An overbed table comprising a base member; a support column mounted to said base member; a cantilever arm mounted to and extending horizontally from said support column; a table top having top and bottom sides and a groove on the bottom side thereof; a mounting bracket secured to the bottom side of said table top and extending over at least part of said groove, said cantilever arm extending within said groove and above said mounting bracket; said support column including a pair of telescoping members, said cantilever arm secured to one of said telescoping members; means for locking the relative positions of said telescoping members to prevent downward movement of said table top; means for unlocking the relative positions of said telescoping members, said unlocking means including a push cap mounted to a top end of one of said telescoping members whereby said table top may be lowered by applying pressure to said push cap.

2. An overbed table comprising a base member; a vertically adjustable support column mounted to said base member; a table top having a bottom side and a top side mounted to said support column; a push cap for effecting vertical adjustment of said support column mounted to a top end thereof; a retaining plate mounted to said bottom side of said table top; and a mirror assembly slidably positioned between said retaining plate and said bottom side of said table top, said mirror assembly including a mounting portion and a pair of mirrors hingedly mounted to said mounting portion at opposite ends thereof, each of said mirrors having a curled outer edge to facilitate grasping by a patient.

3. An overbed table comprising a base member; a support column mounted to said base member; a table top mounted to said support column; said support column including a pair of telescoping members slidably mounted with respect to each other; means for locking one of said telescoping members against downward movement with respect to the other; means for releasing said locking means so that one of said telescoping members may be moved downwardly with respect to the other, said releasing means including an actuating push cap mounted at a top end of one of said telescoping members such that pressure exerted on said push cap allows said one of said telescoping members and said table top to be lowered.

4. An overbed table as defined in claim 3 wherein said releasing means includes a pressure plate, an actuating rod connected to said pressure plate, an actuator roller connected to said actuating rod, and a bracket assembly including a cage, said actuator roller being positioned within said cage, said push cap being in contact with said pressure plate, said cage being shaped such that when pressure is exerted upon said push cap, said actuator roller is moved out of contact with the walls thereof.

* * * * *